United States Patent [19]

Pav et al.

[11] Patent Number: 5,029,521

[45] Date of Patent: Jul. 9, 1991

[54] CALENDER AND METHOD OF OPERATING THE SAME

[75] Inventors: Josef Pav; Gerhard Hartwich, both of Krefeld; Rolf Van Haag, Kerken; Franz Kayser, Geldern, all of Fed. Rep. of Germany

[73] Assignee: Kleinewefers GMBH, Krefeld, Fed. Rep. of Germany

[21] Appl. No.: 259,331

[22] Filed: Oct. 18, 1988

[30] Foreign Application Priority Data

Oct. 20, 1987 [DE] Fed. Rep. of Germany ..... 3735438

[51] Int. Cl.[5] ..... B30B 15/34; B30B 3/04

[52] U.S. Cl. ..... 100/38; 100/35; 100/47; 100/74; 100/93 RP; 100/162 B; 100/163 R; 162/206; 162/360.1

[58] Field of Search ..... 100/35, 38, 43, 47, 100/73-75, 93 RP, 155 R, 162 R, 162 B, 163 R, 163 A, 168, 169, 170; 162/206, 207, 359, 360.1; 72/243, 245, 200, 11, 21, 365, 366, 8, 20; 29/116.2

[56] References Cited

U.S. PATENT DOCUMENTS

| | | | |
|---|---|---|---|
| 2,908,964 | 10/1959 | Appenzeller | 100/155 R X |
| 3,060,843 | 10/1962 | Moore et al. | 100/162 B X |
| 4,290,351 | 9/1981 | Pav et al. . | |
| 4,311,091 | 1/1982 | Pav et al. . | |
| 4,319,522 | 3/1982 | Marchioro et al. | 100/162 B |
| 4,328,744 | 5/1982 | Pav et al. . | |
| 4,347,784 | 9/1982 | Pav et al. . | |
| 4,370,923 | 2/1983 | Schmidt | 100/47 |
| 4,389,932 | 6/1983 | Pav . | |
| 4,389,933 | 6/1983 | Pav . | |
| 4,394,793 | 7/1983 | Pav et al. . | |
| 4,425,489 | 1/1984 | Pav et al. . | |
| 4,434,713 | 3/1984 | Hartwich et al. . | |
| 4,472,958 | 9/1984 | Biondetti | 72/245 X |
| 4,480,459 | 11/1984 | Feldman et al. | 100/162 B X |
| 4,480,537 | 11/1984 | Agronin et al. | 100/38 |
| 4,520,723 | 6/1985 | Pav et al. . | |
| 4,625,637 | 12/1986 | Pav et al. . | |
| 4,633,774 | 1/1987 | Kuosa et al. | 100/47 X |
| 4,653,395 | 3/1987 | Verkasalo | 100/38 |
| 4,729,153 | 3/1988 | Pav et al. . | |
| 4,757,583 | 7/1988 | Pav et al. . | |
| 4,757,584 | 7/1988 | Pav et al. . | |
| 4,848,119 | 7/1989 | Pav et al. | 100/162 B X |

FOREIGN PATENT DOCUMENTS 3200490 9/1982 Fed. Rep. of Germany .

OTHER PUBLICATIONS

"Nipco-Walzen in Superkalandern", Stotz, 1986, pp. 976-983.

"Nip Load Uniformity and its control in Multi-Roll Calenders", Mueller et al., Apr. 1986, pp. 88-94.

*Primary Examiner*—Philip R. Col
*Assistant Examiner*—Stephen F. Gerrity
*Attorney, Agent, or Firm*—Peter K. Kontler

[57] ABSTRACT

A calendar wherein a bottom roll and a deformable top roll flank one or more intermediate rolls is operated in such a way that the shape of the top roll is caused to conform to that of the adjacent intermediate roll before the nip of the top roll with the adjacent roll is narrowed. At least the top roll is heated to enhance the satinizing effect upon paper webs without unduly affecting the specific volume of treated material. It is further proposed to subject the bottom roll to preliminary deformation and/or to heat the bottom roll and/or one or more intermediate rolls.

42 Claims, 4 Drawing Sheets

TEMPERATURE SENSOR
HYDRAULIC MOTOR
MOISTURIZING DEVICE
TEMPERATURE ADJUSTER
ADJUSTER
MONITOR
SIGNAL TRANSMITTER
TEMPERATURE ADJUSTERS
CONTROL UNIT
COMPUTER
REGULATOR
TEMPERATURE SENSORS
TEMPERATURE ADJUSTERS
TEMPERATURE SENSORS
SIGNAL TRANSMITTER
MONITOR
ADJUSTER
TEMPERATURE ADJUSTER
HYDRAULIC MOTOR
26
58
79
24
44
45
46
69
70
22
21
4
42
41
43
47
49
60
62
6
65
59
67
50
7
75
73
51
64
8
77
55
12
74
76
78
56
66
68
13
63
57
61
32
48
71
72
34
5
31
17

CALENDER AND METHOD OF OPERATING THE SAME

BACKGROUND OF THE INVENTION

The invention relates to improvements in calenders in general and to improvements in methods of operating calenders. More particularly, the invention relates to improvements in calenders (especially supercalenders) and to improvements in methods of operating calenders of the type wherein a top roll and a bottom roll flank one or more intermediate rolls and the bottom and/or top roll is deformable so that it can select the profile of the nip between such deformable roll and the neighboring roll.

It is well known to provide a calender with a deformable top roll and/or with a deformable bottom roll and to operate the calender in such a way that the bottom roll is first caused to close the lowermost nip, thereupon the next-to-the-lowermost nip, and so forth. Such closing of the nips starting at the bottom and proceeding toward the top takes place after the material (such as a web of paper) has been properly threaded through the nips and is trained over one or more guide rollers or the like. As a rule, calenders of the just described character are used for the treatment of paper webs; however, they can also be used for the treatment of other materials such as plastic foils or the like. As used herein, the term calender is intended to embrace all kinds of machines (including smoothing, printing and rolling machines) wherein top and bottom rolls flank one or more intermediate rolls and define therewith nips for the passage of paper webs or other materials which are to be treated in the nips as a result of the application of heat and/or pressure.

Commonly owned U.S. Pat. No. 4,625,637 to Pav et al. discloses a roll assembly for use in calenders wherein the top and bottom rolls have deformable cylindrical shells and flank a set of intermediate rolls. The shells of the bottom and top rolls are rotatable about and include portions which are movable radially of non-rotatable carriers. The shells confine rows of primary deforming elements in the form of hydrostatic bearings which can be operated to change the shape of the shells as well as to urge selected portions of the shells against the adjacent intermediate rolls with a given force. Each shell further confines at least one row of secondary deforming elements which are disposed diametrically opposite the respective primary deforming elements. Each deforming element includes a cylinder and piston unit and has a hydrostatic bearing member which is adjacent the internal surface of the respective shell. Adjusting means is provided to regulate the pressure in selected cylinder and piston units and to thus select the force with which the corresponding portions of the shell bear upon running webs in the respective portions of the nip. This patent further discloses the possibility of heating one or more hard intermediate rolls.

The axes of intermediate rolls in the patented calender are bent, mainly as a result of the action of overhanging weights upon their ends. Therefore, the central portions of the rolls bulge upwardly and are convex from above and concave from below when the calender is not in use. This renders it necessary to conform the shapes of the top and bottom rolls to the shapes of the adjacent intermediate rolls in order to achieve uniform load distribution along the nips. When the threading of a web through the nips is completed and the width of the nips is reduced, starting with the lowermost nip and proceeding toward the nip of the top roll and the adjacent topmost intermediate roll, the upwardly bent median portion of the topmost intermediate roll is caused to engage the web at the center of the top roll while such center of the top roll has a straight horizontal axis or sags downwardly under the weight of the median portion of the top roll. Attempts to avoid a mere point contact between the shell of the top roll and the web in the nip of the top roll with the adjacent topmost intermediate roll include the application of pressure to those primary deforming elements in the shell of the top roll which are adjacent the axial ends of such shell. This necessitates the application of high pressures, i.e., the pressure in the nip of the top roll with the adjacent intermediate roll is very high which is often undesirable for a number of reasons. In addition, the pressure in the top nip is raised as a result of application of external forces. The nip load increases from nip to nip in a direction from the uppermost nip toward the nip of the bottom roll and the adjacent lowermost intermediate roll. Such linear increase of nip load is due to the fact that each lower roll must bear the weight of the roll or rolls above it. High nip loads are undesirable in connection with the treatment of many types of materials. For example, if the nip load is high, satisfactory gloss, smoothness and receptivity to print can be achieved only as a result of pronounced densification of the material.

Another undesirable effect of pronounced nip loads is that they shorten the useful life of certain types of rolls. For example, if the top roll is adjacent an intermediate roll which has an outermost layer of elastic material, the initial mere point contact with the top roll and the immediately following pronounced increase of nip load in the nip of the top roll with the elastic intermediate roll can entail immediate pronounced or even irreparable damage to the intermediate roll. Many calenders employ an elastic intermediate roll immediately adjacent the top roll. The situation is not improved if the topmost intermediate roll is initially engaged by a relatively short central portion of the shell of the top roll, i.e., if a mere point contact is replaced with a short linear contact.

Calenders with deformable top and/or bottom rolls are also described in U.S. Pat. No. 4,480,537 to Agronin et al., in the April 1986 Tappi Journal (pages 88–94) and on pages 976–982 of WOCHENBLATT FÜR PAPIERFABRIKATION (23/24, 1986).

OBJECTS OF THE INVENTION

An object of the invention is to provide a novel and improved method of operating a calender, particularly a supercalender, in such a way that its rolls can stand longer periods of use.

Another object of the invention is to provide a method which renders it possible to enhance the gloss and smoothness of treated materials.

A further object of the invention is to provide a novel and improved method of selecting the load distribution in the nips of rolls in a calender.

An additional object of the invention is to provide a method which is beneficial to the specific volume of treated materials, such as webs or strips of paper.

Still another object of the invention is to provide a method which renders it possible to rapidly adjust the load distribution in the nips if a monitoring of the treated material reveals that such adjustment is desirable or necessary.

An additional object is to provide a method which avoids the drawbacks but exhibits the advantages of heretofore known methods.

A further object of the invention is to provide a novel and improved calender which can be used for the practice of the above outlined method and whose dimensions as well as certain other parameters need not appreciably depart from those of heretofore known calenders.

An additional object of the invention is to provide the calender with novel and improved means for deforming selected rolls.

Another object of the invention is to provide the calender with novel and improved means for influencing the temperature of selected rolls.

A further object of the invention is to provide a calender wherein one and the same means can influence the temperature as well as the shape of selected rolls.

Another object of the invention is to provide novel and improved rolls for use in the above outlined calender.

An additional object of the invention is to provide a calender which can turn out products exhibiting a more satisfactory gloss and a more satisfactory smoothness than the products which issue from heretofore known calenders.

A further object of the invention is to provide novel and improved controls for the rolls of a supercalender.

Another object of the invention is to provide a calender which reduces undesirable reduction of specific volume of satinized paper webs.

A further object of the invention is to provide a calender which is capable of carrying out satinizing operations in a manner which is more economical than in heretofore known calenders.

SUMMARY OF THE INVENTION

One feature of the present invention resides in the provision of a method of operating a calender, particularly a supercalender, wherein a bottom roll (also called king roll) and a deformable top roll (also called queen roll) define nips of variable width with at least one intermediate roll, and the material (e.g., a web of paper, fabric or foil) which is to be calendered is threaded through the nips (e.g., first through the topmost nip, thereupon through the next to the topmost nip, and so forth). The improved method comprises the steps of deforming the top roll so that its shape conforms to that of the intermediate roll next to it, reducing the width of one of the first and second nips, and reducing the width of the other of the first and second nips. The deforming step precedes the step of reducing the width of the second nip, and the step of reducing the width of the first nip preferably precedes the step of reducing the width of the second nip.

The method can further comprise the step of applying a load to at least one of the bottom and top rolls in a direction to urge at least one of the top and bottom rolls toward the intermediate roll or rolls upon completion of the width reducing steps. The load applying step includes applying to at least one of the top and bottom rolls a force other than gravity. Such load applying step can include establishing uniform load distribution in that nip which is adjacent the nip of at least one of top and bottom rolls with the at least one intermediate roll. This method can further comprise the steps of monitoring at least one parameter of calendered material, comparing the monitored parameter with a predetermined parameter (reference value), and applying to at least one of the top and bottom rolls at least one additional load when the monitored parameter deviates from the reference value so as to eliminate or at least reduce the deviation.

If the bottom roll is also deformable, the method can further comprise the step of deforming the bottom roll not later than during reduction of the width of the first nip so as to establish uniform load distribution in the first nip. The step of deforming the bottom roll is preferably carried out by full consideration of the influence of the weight of the intermediate roll or rolls upon the bottom roll on the load distribution in the first nip. The step of deforming the bottom roll can include establishing uniform load distribution in the first nip and in the nip which is adjacent the first nip.

The method can further comprise the step of calculating the desired configuration of the top roll in accordance with a predetermined algorithm, and the deforming step can include deforming the top roll in accordance with the results of the calculating step. In addition to or in lieu of the just discussed calculating step, the method can comprise the step of calculating the desired load distribution in the second nip in accordance with a predetermined algorithm, and the deforming step can include deforming the top roll in accordance with the results of such calculating step.

The method can also comprise the step of compensating, at least in part, for the effect of the weight of the top roll upon the width of the nips.

Another feature of the invention resides in the provision of a method of operating a calender, particularly a supercalender, wherein a bottom roll and a deformable top roll flank and respectively define first and second nips of variable width with at least one intermediate roll, and the material to be calendered is threaded through the nips. The method comprises heating at least a portion of the top roll to a predetermined temperature, reducing the width of one of the first and second nips, and reducing the width of the other of the first and second nips. Such method can also comprise the step of deforming the top roll so that its shape conforms to that of the adjacent intermediate roll prior to the width reducing steps, and the step of reducing the width of the first nip preferably precedes the step of reducing the width of the second nip. Such method can further comprise the step or steps of heating the bottom roll and/or the intermediate roll or rolls to a predetermined temperature.

Still further, such method can comprise the step of calculating the desired temperature of the aforementioned portion of the top roll in accordance with a predetermined algorithm, and the step of heating a portion of or the entire top roll can include selecting the temperature of a portion of or the entire top roll in accordance with the results of the calculating step. Still further, the method can comprise the step of regulating the ratio of load distribution upon the material in the second nip to the influence of heat energy upon the material in the second nip as a function of desired parameters of calendered material. Still further, the method can comprise the step of moisturizing the material (particularly webs of paper) prior to threading the material through the nips. The moisturizing step can include increasing the moisture content of paper to between 7 and 18 percent by weight, preferably to between 9 and 18 percent, and most preferably to between 9 and 15 percent.

The step of heating a portion of or the entire top roll can include raising the temperature of a portion of or the entire top roll to between 80° and 160° C., preferably to between 100° and 140° C.

A further feature of the invention resides in the provision of a calender, particularly a supercalender, which comprises a deformable top roll, a bottom roll, at least one intermediate roll which respectively defines with the bottom and top rolls first and second nips of variable width, means for moving the top roll relative to the bottom roll to thereby vary the width of at least one of the first and second nips, and preferably adjustable means for deforming the top roll relative to and independently of the adjacent intermediate roll. The deforming means can include means for imparting to the top roll a shape which conforms to that of the adjacent intermediate roll.

The top roll preferably comprises an elongated carrier and an elongated deformable cylindrical shell which spacedly surrounds the carrier. The means for deforming such top roll can comprise a plurality of adjustable deforming elements (e.g., hydrostatic bearing elements) which are disposed between the carrier and the shell and form at least one row extending longitudinally of the shell, and means for adjusting the deforming elements. The deforming elements can include at least one row of primary deforming elements which are nearer to the second nip (they can be immediately adjacent the second nip) and at least one row of secondary deforming elements which are remote from the second nip (the row or rows of secondary deforming elements can be disposed between the carrier and the shell diametrically opposite the row or rows of primary deforming elements).

The top roll can further comprise first and second rings which spacedly surround the carrier and are rotatably journalled in the respective end portions of the shell, and such calender further comprises means for moving the rings relative to the carrier substantially radially of the shell. The moving means for each of the rings can include a first fluid-operated motor adjacent the second nip and a second fluid-operated motor which is remote from the second nip. Each such motor can include a piston on the respective ring and a cylinder for the piston on or in the carrier. For example, each cylinder can constitute an integral part of the carrier and includes a cylinder chamber for the respective piston.

The calender can further comprise means for locating the end portions of the shell of the top roll in predetermined positions relative to the carrier. Such locating means can include the aforementioned fluid-operated motors and valves or other suitable means which can be operated to confine a supply of fluid in the cylinder of each motor to thereby hold the pistons in preselected positions relative to the associated cylinders.

The means for moving the top roll relative to the bottom roll and relative to the intermediate roll or rolls can comprise motors which are mounted in or on the frame of the calender and engage the end portions of the carrier so that they can move the end portions of the carrier relative to the intermediate roll or rolls, and means for operating the motors.

An additional feature of the invention resides in the provision of a calender, particularly a supercalender, which comprises a deformable top roll, a bottom roll, at least one intermediate roll which defines with the bottom and top rolls first and second nips of variable width, means for moving the top roll relative to the bottom roll to thereby vary the width of at least one of the nips, means for deforming the top roll, adjustable heating means for the top roll, and means for adjusting the heating means so as to maintain the temperature of at least a portion of or of the entire top roll within a predetermined range. The top roll is or can be hollow, and the means for heating a hollow top roll can comprise a source of heating fluid and means for connecting the source with the interior of the roll. The adjusting means of such calender can comprise means for regulating the flow of heating fluid between the source and the interior of the top roll. As stated above, the means for deforming the top roll can comprise a plurality of hydrostatic bearing elements which are provided in the top roll and form at least one row extending longitudinally of the top roll. Such deforming means can further comprise means for connecting the hydrostatic bearing elements with the source of heating fluid, and means for regulating the flow of fluid between the source and the bearing elements. Thus, the heating means can constitute a component part of the means for deforming the top roll or vice versa.

The calender can further comprise adjustable means for heating the bottom roll and/or the intermediate roll or rolls.

If the material to be calendered is in the form of paper webs, the calender can further comprise means for moisturizing the webs prior to their treatment in the nips.

The calender can also comprise means for monitoring at least one parameter of calendered material and means for adjusting the means for deforming the top roll when the monitored parameter deviates from a desired parameter (reference value). The means for adjusting the heating means can include means for adjusting such heating means as a function of deviation of the monitored parameter from a predetermined parameter.

The means for adjusting the means for deforming the top roll can include means for adjusting such deforming means in accordance with a predetermined algorithm. The same holds true for the means for adjusting the heating means for the top roll.

The novel features which are considered as characteristic of the invention are set forth in particular in the appended claims. The improved calender itself, however, both as to its construction and its mode of operation, together with additional features and advantages thereof, will be best understood upon perusal of the following detailed description of certain specific embodiments with reference to the accompanying drawing.

DESCRIPTION OF PREFERRED EMBODIMENTS

Figure 1:
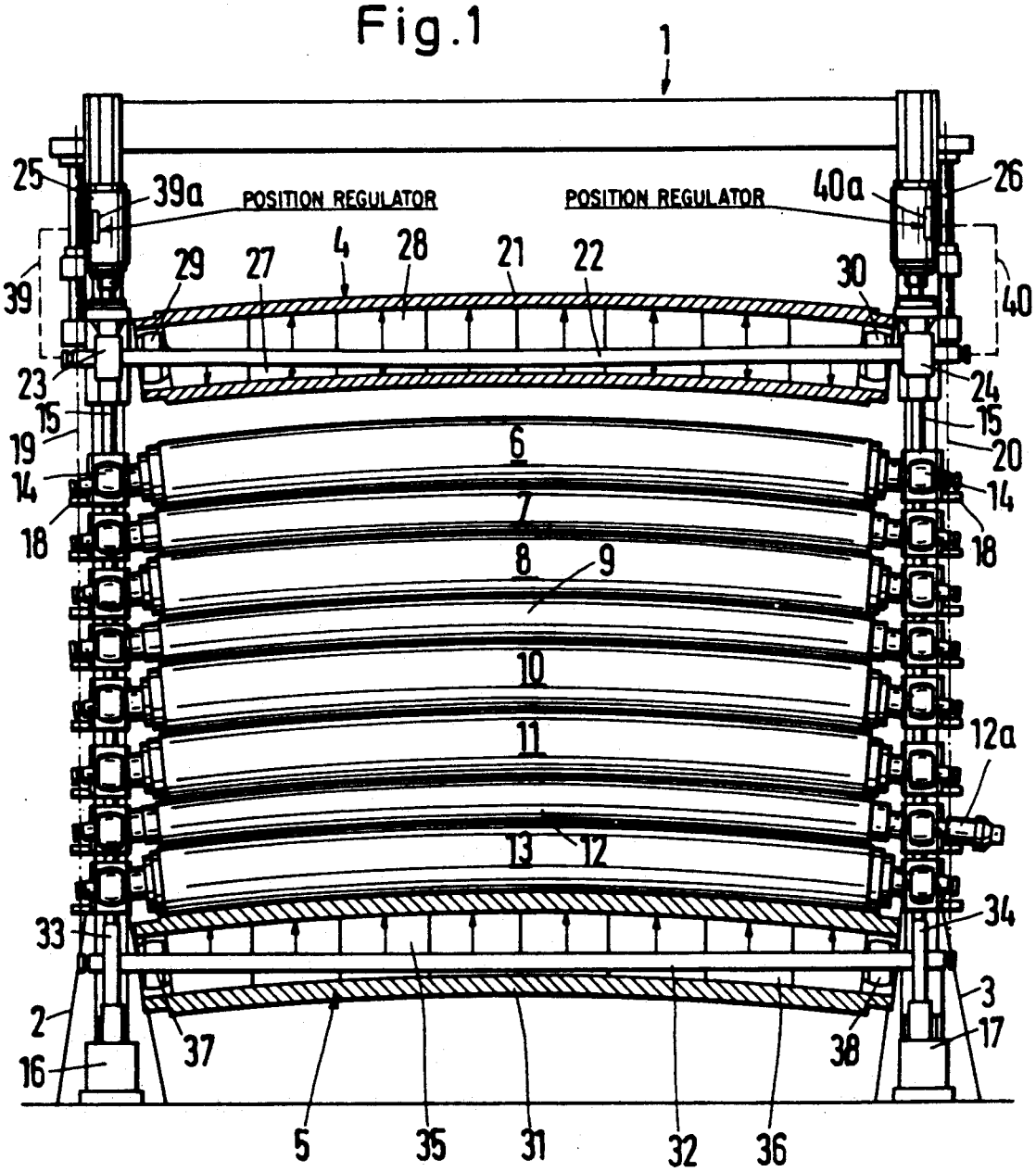
FIG. 1 is a front elevational view of a calender which embodies one form of the invention, the shells of the top and bottom rolls being shown in an axial sectional view.

Referring first to FIG. 1, there is shown a calender having a frame 1 including two upright frame members 2, 3 for the end portions of a deformable top or king roll 4, a deformable bottom or queen roll 5, and eight intermediate rolls 6, 7, 8, 9, 10, 11, 12 and 13. The intermediate rolls 6, 8, 10, 11 and 13 have elastic outer layers, and the rolls 7, 9 and 12 are hard rolls. The bearings 14 for the end portions of intermediate rolls 6 to 13 are movable up or down along substantially vertically extending guides 15 when the bottom roll 5 is moved to or from the raised position shown in FIG. 1. The means for moving the bottom roll 5 up and down in order to vary the width of the nip 57 (FIG. 2) of this roll with the adjacent lowermost intermediate roll 13 comprises two fluid-operated (particularly hydraulic) motors 16 and 17. When the motors 16, 17 cause or permit the bottom roll 5 to descend and to thus increase the width of the nip 57, the bearings 14 at the ends of intermediate rolls 6 to 13 come to rest on stops 18 which are adjustably mounted on two upright spindles 19 and 20. Reference may be had to numerous United States and foreign patents of the assignee of the present application, for example, to U.S. Pats. Nos. 4,290,351 to Pav. et al., 4,311,091 to Pav et al., 4,347,784 to Pav et al., 4,389,932 to Pav, 4,389,933 to Pav and 4,434,713 to Hartwich et al.

The intermediate roll 12 is driven by a suitable prime mover, not shown. FIG. 1 merely shows an element 12*a* which transmits torque to the right-hand end portion of the roll 12.

The top roll 4 comprises an elongated carrier 22 and an elongated cylindrical shell 21 which spacedly surrounds the carrier 22 and is deformable in a manner to conform its shape to that of the adjacent intermediate roll 6 prior to a reduction of the width of nip 49 (FIG. 2) between the rolls 4 and 6. The shell 21 is rotatable relative to the carrier 22 whose end portions are non-rotatably but vertically movably installed in the frame members 2 and 3. The end portions of the carrier 22 are mounted in bearings 23, 24 which are movable up and down by hydraulic motors 25, 26, respectively. These motors are installed in or on the corresponding frame members 2, 3 and can be operated to raise or lower the respective bearings 23, 24, i.e., to move the top roll 4 away from or nearer to the topmost intermediate roll 6. The motors 25, 26 can move the top roll 4 to any one of a desired number of different levels.

The means for deforming the shell 21 of the top roll 4 comprises at least one row of primary deforming elements 27 which are surrounded by the shell 21 and operate between this shell and the carrier 22 immediately adjacent the nip 49, and at least one row of secondary deforming elements 28 which are remote from the nip 49 and are disposed substantially diametrically opposite the row of primary deforming elements 27. The rows of deforming elements 27, 28 extend in the longitudinal direction of the shell 21. The elements 27 and 28 are deformable in response to admission or evacuation of a suitable fluid medium, e.g., oil, which can be admitted at a desired pressure in a manner well known from the art of deformable rolls for calenders. When the pressure of fluid which is admitted to the primary deforming elements 27 is increased, these elements move the corresponding portions of the shell 21 toward the topmost intermediate roll 6. The secondary deforming elements 28 counteract the deforming action of the primary deforming elements 27 and can be operated to move the corresponding portions of the shell 21 relative to the carrier 22, namely upwardly and away from the intermediate roll 6.

The end portions of the shell 21 surround annular bearings 29, 30. The inner races of such bearings can be mounted on the respective end portions of the carrier 22 in such a way that the end portions of the shell 21 are held against any radial movement relative to the carrier. Alternatively, the bearings 29, 30 can be designed to permit the respective end portions of the shell 21 to move radially relative to the adjacent end portions of the carrier 22. Reference may be had to commonly owned U.S. Pat. No. 4,520,723 to Pav et al.

The aforementioned motors 25, 26 for the bearings 23, 24 at the respective ends of the carrier 22 are operatively connected (as at 39, 40) with discrete position regulators 39*a*, 40*a*. The purpose of regulators 39*a*, 40*a* is to permit selection of the levels of the respective bearings 23, 24 with a very high degree of accuracy.

The bottom roll 5 is also deformable, and its construction can match that of the top roll 4. FIG. 1 shows that the bottom roll 5 comprises a carrier 32 with annular bearings 37, 38 for the end portions of a deformable hollow cylindrical shell 31. The end portions of the carrier 32 are mounted in bearings 33, 34 which are movable up and down by the respective motors 16, 17. Each such motor can constitute a fluid-operated (particularly hydraulic) cylinder and piston unit. The means for deforming the shell 31 relative to the carrier 32 and relative to the adjacent lowermost intermediate roll 13 comprises at least one row of primary deforming elements 35 which can be operated in a manner analogous to that of the primary elements 27 to move the corresponding portions of the shell 31 toward the lowermost intermediate roll 13, and at least one row of secondary deforming elements 36 which can be operated in a manner analogous to that of the elements 28 to oppose the deforming action of the primary deforming elements 35 or to move the corresponding portions of the shell 31 downwardly and away from the intermediate roll 13. The deforming elements 35, 36 form at least two rows which extend longitudinally of the carrier 32 and shell 31. These deforming elements are designed to be adjusted in response to admission of a hydraulic fluid at any one of several different pressures.

The construction and mode of operation of deforming elements 27, 28 and/or 35, 36 can be identical with or similar to that of deforming elements which are disclosed in commonly owned U.S. Pat. No. 4,328,744 to Pav et al. or in commonly owned U.S. Pat. No. 4,394,793 to Pav et al.

Figure 2:
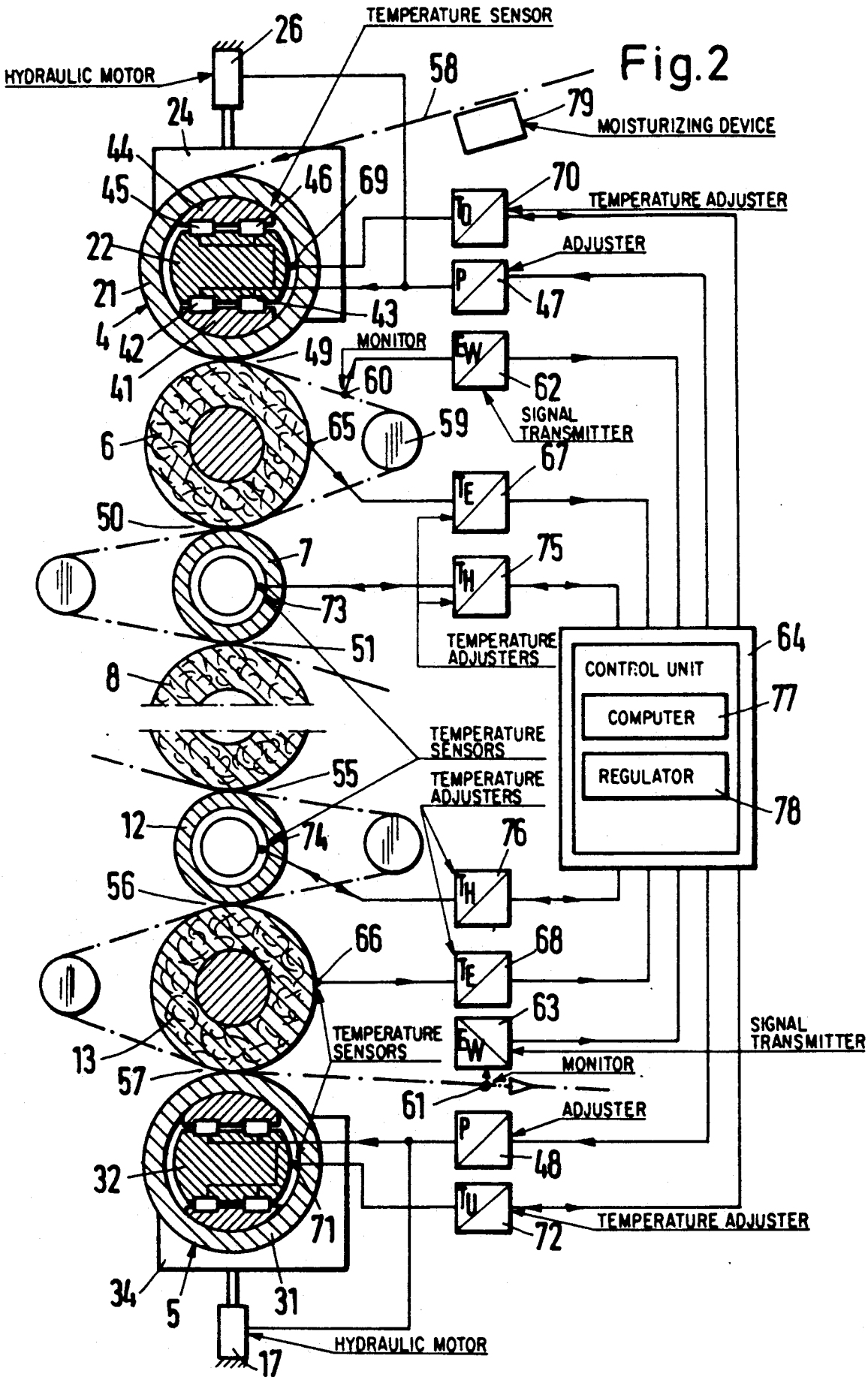
FIG. 2 is an enlarged fragmentary transverse vertical sectional view of a calender which constitutes a slight modification of the calender of FIG. 1.

FIG. 2 shows a slightly modified top roll 4 wherein each primary deforming element 41 is acted upon by fluid in two plenum chambers 42, 43 and each secondary deforming element 44 is acted upon by fluid in two plenum chambers 45, 46. The construction of the bottom roll 5 which is shown in FIG. 2 is or can be identical with that of the top roll 4 of FIG. 2.

The means for adjusting the elements 41, 44 in the shell 21 of the top roll 4 of FIG. 2 is shown at 47. The fluid pressure p is adjustable for each of the chambers 42, 43, 45, 46 independently of the other chambers, or such pressure is adjustable for groups of chambers independently of other groups of chambers. This ensures that the primary and/or secondary deforming elements 41, 44 can be adjusted independently of one another or that pairs or other groupings of deforming elements can be adjusted as a unit relative to other deforming elements. The means for adjusting the deforming elements in the shell 31 of the bottom roll 5 of FIG. 2 is shown at 48. The exact construction of the adjusting means 47 and/or 48 forms no part of the present invention. Reference may be had, for example, to commonly owned U.S. Pat. No. 4,625,637 to Pav et al.

FIG. 2 shows the calender in actual use, i.e., the width of the gaps between neighboring rolls is reduced and a web 58 of material to be treated (e.g., a strip of paper) is threaded through successive nips starting with the nip 49 of the rolls 4, 6, proceeding with the nip 50 of the rolls 6, 7, with the nip 51 of the rolls 7, 8, with the nips (not shown) of the rolls 8–9, 9–10, 10–11 (rolls 9 and 10 are not shown in FIG. 2), with the nip 55 of the rolls 11, 12, with the nip 56 of the rolls 12, 13 and terminating with the nip 57 of the rolls 5, 13. The web 58 is trained over several guide rollers 59.

FIG. 2 further shows monitoring devices 60 which monitor one or more interesting parameters EW of the web 58 between the nip 49 and the topmost guide roller 59, and monitoring devices 61 which monitor one or more parameters EW of the web 58 downstream of the lowermost nip 57. The monitoring devices 60 and 61 form rows which extend transversely of the path of movement of the web 58. For example, such devices can monitor the gloss and smoothness of successive increments of the respective longitudinally extending portions of the web 58. The monitoring devices 60, 61 respectively cooperate with signal transmitting and/or amplifying units 62, 63 which serve to transmit signals to the corresponding inputs of a control unit 64. The latter controls the operation of adjusting means 47, 48 for the deforming elements in the rolls 4 and 5. Still further, the control unit 64 receives signals from discrete sensors 65 and 66 which monitor the temperature TE at the surfaces of the intermediate rolls 6 and 13. Additional sensors (not shown) are provided to monitor the temperature of intermediate rolls 8, 10 and 11. The sensors 65 and 66 form rows which extend longitudinally of the respective intermediate rolls 6 and 13. Alternatively, it is possible to employ sensors which are reciprocable back and forth longitudinally of the respective rolls. Reference may be had to commonly owned U.S. Pat. No. 4,425,489 to Pav et al. Signals which are generated by sensors 65 and 66 are transmitted by units 67, 68 which are connected with the corresponding inputs of the control unit 64.

The top roll 4 can be heated with a fluid medium, and the calender of FIG. 2 further comprises a sensor 69 or a system of sensors serving to monitor the temperature TO of the roll 4 and to transmit signals to the control unit 64 by way of an adjusting device 70 which can also receive signals from the unit 64 to select the temperature of the top roll 4. Analogously, the temperature TU of the bottom roll 5 is monitored by one or more sensors 71 which transmit signals to an adjusting unit 72. The latter is connected with the control unit 64 and serves to transmit signals denoting the temperature TU to the control unit as well as to receive from the control unit signals which are used to adjust the temperature of the bottom roll 5.

Additional sensors 73, 74 are respectively provided to monitor the temperature TH of the rolls 7 and 12 and to transmit appropriate signals to adjusting units 75, 76 which can alter or initiate an altering of the temperatures of the respective intermediate rolls. The calender can be provided with means for monitoring the temperature of each and every roll and for adjusting the temperature when the monitored temperature deviates from a desirable optimium value.

The control unit 64 comprises a computer 77 and a regulator 78. The computer 77 serves as a means for calculating the manner of adjusting one or more rolls in accordance with a predetermined algorithm on the basis of information which is obtained from the aforedescribed monitoring means 60, 61 and sensors 65, 66, 69, 70, 73 and 74. Furthermore, the computer 77 takes into consideration the desired parameters of the web 58, i.e., the desired load parameters which must be selected in dependency upon the desired parameters of treated material. The signals which are transmitted by the computer 77 denote the required temperatures of the rolls as well as the forces with which the rolls must bear upon the material 58 which is caused to advance through the nips. These signals are corrected, when necessary, on the basis of information which is furnished by the monitoring devices 60, 61 and temperature sensors 65, 66, 69, 70 and 73, 74 (as well as by other sensors if the calender is equipped with means for monitoring the temperature of each and every roll). The purpose of the regulator 78 is to induce the various adjusting means to carry out adjustments in accordance with signals which are transmitted by the computer 77. Reference may be had, for example, to commonly owned copending patent application Ser. No. 07/192,594 which discloses a suitable control unit.

The calender preferably further comprises a suitable moisturizing device 79 which is adjacent the path of movement of the web 58 toward the nip 49 of the rolls 4, 6 and increases the moisture content of the web if the latter consists of paper and is to be subjected to a particular type of treatment. The moisturizing device 79 can receive signals from the control unit 64 so that its moisturizing action can be adjusted as a function of changes of temperature at the periphery of the top roll 4. The moisture content of the web 58 will be increased if the temperature of the roll 4 is higher because the roll 4 is then capable of expelling a higher percentage of moisture from successive increments of the running web 58. Such treatment enhances the strength and the ability of the web to accept printed matter.

The calender of FIG. 2 can be operated in the following way:

When the calender is not in use, the bottom roll 5 is held in the lower end position of FIG. 1 so that the bearings 14 for the intermediate rolls 6–13 can descend onto and come to rest on the corresponding stops 18. The top roll 4 is held by the motors 25 and 26 so that the nip 49 is open. The intermediate rolls 6–13 are deformed, for example, by the weight of the associated guide rolls 59, so that they assume a concavo-convex shape as shown, greatly exaggerated, in FIG. 1 of the drawing. If the bottom roll 5 is then lifted by the motors 16 and 17, it lifts the lowermost intermediate roll 13 off the respective stops 18, the roll 13 thereupon lifts the roll 12 off the respective stops 18, and so forth.

The pressure in the deforming elements (such as 35, 36) for the shell 31 of the bottom roll 5 is selected (by the control unit 64) in advance in such a way that the shape of the shell 31 conforms to that of the intermediate roll 13 before the shell 31 actually engages the roll 13 or the web 58 in the nip 57. As a rule, or in many instances, it suffices to adjust the primary deforming elements 35 in order to conform the shape of the roll 5 to that of the roll 13 before the motors 16, 17 are caused to lift the bottom roll 5 to the operative position of FIG. 2. Such adjustment of the shape of shell 31 prior to lifting of the roll 5 ensures that the load distribution in the nip 57 is uniform all the way across the width of the web 58. Since the data of the calender are known, the computer 77 can calculate the required adjustment of the secondary deforming elements 36 and/or primary deforming elements 35 before the motors 16, 17 are started to lift the bottom roll 31. Deformation of the shell 5 is changed stepwise when the shell 31 begins to lift the roll 13, when the roll 13 begins to lift the roll 12, and so on, in order to account for the weight of a progressively increasing number of intermediate rolls which are caused to bear upon the shell 31 as a result of lifting of the bottom roll 5 by the motors 16 and 17. Such repeated adjustment of the shape of the bottom roll 5 ensures that the load distribution in the nip 57 remains uniform in spite of the fact that the shell 31 is then called upon to carry an increasing number of intermediate rolls.

The top roll 4 is deformed so that its shape conforms to that of the topmost intermediate roll 6 before the motors 25 and 26 are caused to lower the carrier 22 so as to reduce the width of the nip 49. This can be readily seen in FIG. 1. Thus, the shell 21 of the top roll 4 can be moved into linear contact with the roll 6 when the width of the nip 49 is reduced and in the absence of a web 58 between the rolls 4 and 6. Such advance deformation of the shell 21 is carried out in accordance with the results of calculations which are carried out by the computer 77 on the basis of a predetermined algorithm. The curvature which is shown in FIG. 1 can be achieved by raising the pressure in the primary deforming elements 27 adjacent the bearings 29, 30 and by raising the pressure in the centrally located secondary deforming elements 28. If the inner races of the bearings 29, 30 cannot move with reference to the carrier 22 in the radial direction of the end portions of the shell 21, it often suffices to admit pressurized fluid only to one or more centrally located secondary bearing elements 28.

An important advantage of the just described mode of operating the calender of FIG. 1 or 2 is that the load distribution in the nips 49 and 57 is uniform right from the start, i.e., that it is not necessary to rely on the application of additional or auxiliary forces in order to achieve a highly satisfactory load distribution across the full width of the material which is caused to advance in a direction from the nip 49 toward and through the nip 57. Moreover, this ensures that the elastic outer layers of the intermediate rolls 6 and 13 are treated gently and can stand much longer periods of use.

The load upon the web 58 in the nip 49 can be reduced to a very low value, for example, by causing the position regulators 39*a*, 40*a* to select for the end portions of the carrier 22 accurately determined positions and the end portions of the shell 21 are not permitted to move radially with respect to the respective end portions of the carrier 22. This is desirable and advantageous because the weight of the top roll 4 cannot influence the load distribution in the nips beneath the nip 49. In fact, by properly selecting the deformation of the shell 21 and by properly selecting the level of the carrier 32 through the medium of the motors 16 and 17, the load upon the web 58 in the nip 49 can be maintained close to zero. This is achieved by the expedient of causing the motors 16 and 17 to bear the combined weight of the bottom roll 5 and intermediate rolls 6 to 13.

Of course, the load upon the web 58 in the nips can be increased by causing the motors 16, 17 to raise the bottom roll 5 above the just discussed level. In most instances, such lifting of the bottom roll 5 renders it necessary to alter the distribution of loads along the nip 49 as well as along the nip 57 in response to admission of fluid at different pressure to selected deforming elements in the shells 21 and 31. The purpose of such adjustment of loads along the nips 49 and 57 is to ensure that the distribution of loads along the adjacent nips 50 and 56 continues to remain uniform. Eventually necessary local adjustments of load in selected portions of the nips will be achieved by superimposition of additional forces or loads, for example, to eliminate deviations of monitored parameters EW from desired parameters if the signals from the monitoring device 60 and/or 61 indicate that such localized adjustments are desirable or necessary.

As already described above, at least the rolls 4, 5, 7 and 12 can be heated to a desired temperature. This is of particular importance for proper treatment of the web 58 in the topmost nip 49 because the relatively cold web 58 can be abruptly heated to a temperature which ensures pronounced plastification of conveyed material. Proper heating of the roll 4 reduces losses of specific volume of satinized paper and enhances the economy of the satinizing operation.

The moisturizing device 79 is operated in such a way that it raises the moisture content of a paper web as a function of selected temperature of the roll or rolls. A highly satisfactory moisture content is between 7 and 18 percent by weight, particularly 9 to 18 percent and most preferably 9 to 15 percent. The temperature of the rolls, aprticularly of the top roll 4, is preferably maintained within the range of between 80° and 160° C., most preferably between 100° and 140° C.

Figure 3:
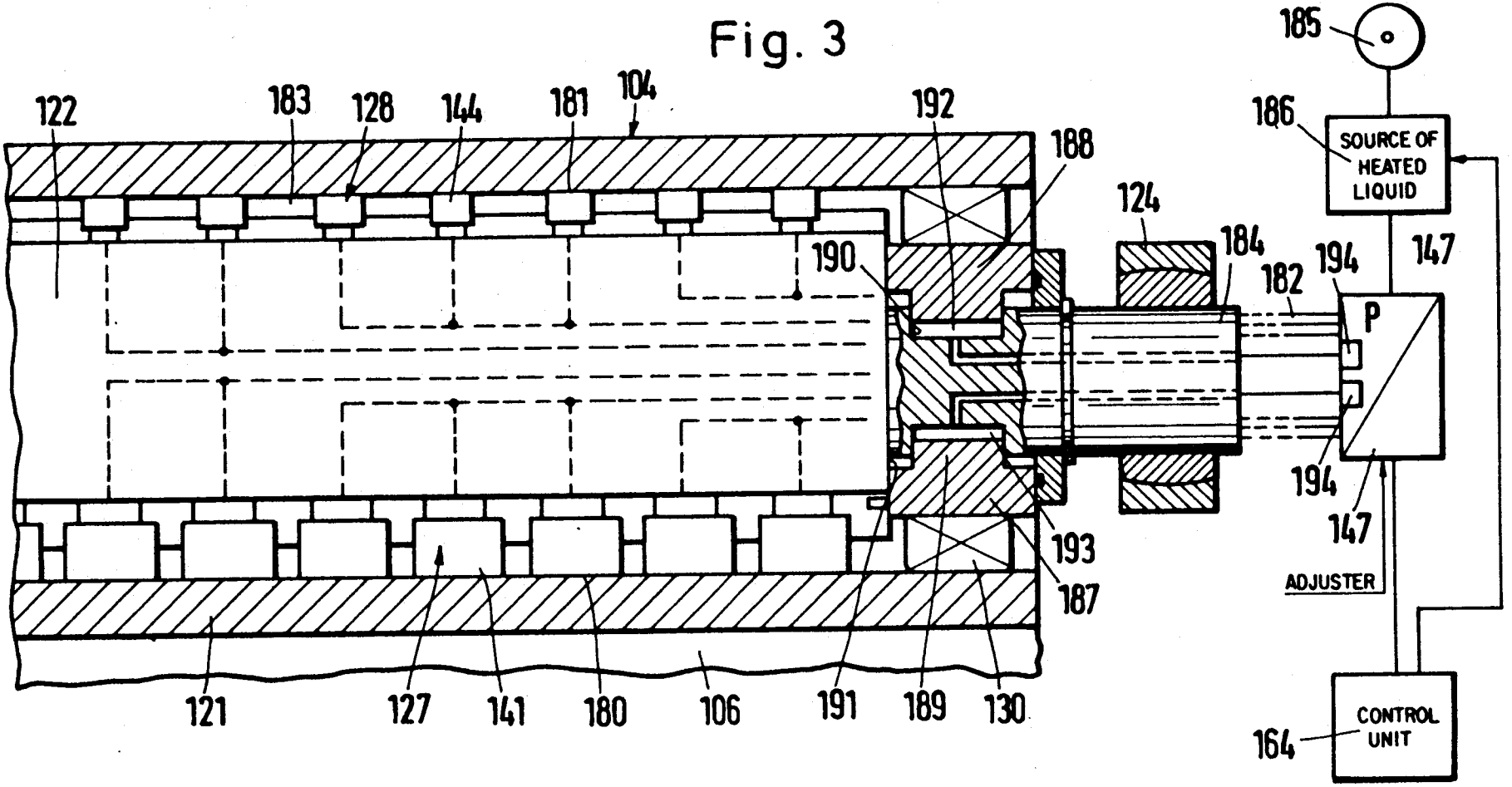
FIG. 3 is a greatly enlarged partly front elevational and partly longitudinal vertical sectional view of a third calender.

FIG. 3 shows a portion of a modified calender which employs a somewhat different top roll 104. All such parts which are identical with or clearly analogous to those of the heretofore described top rolls are denoted by similar reference characters plus 100. The primary deforming elements 127 include hydrostatic bearings 141 each having a hydrostatic convex surface 180 adjacent the internal surface of the shell 121. Each surface 180 has one or more pocket-like recesses or depressions communicating with plenum chambers by way of flow restricting passages. The secondary deforming elements 128 include hydrostatic bearings 144 with hydrostatic surfaces 181 adjacent the internal surface of the shell 121 substantially diametrically opposite the surfaces 180. The area of the surfaces 181 is smaller than that of the surfaces 180. As indicated by broken lines, the bearing elements 127 are connected into groups of three, and each such group receives a pressurized hydraulic fluid through a common conduit including a channel in the carrier 122 and a hose 182 which connects the respective group with a source 186 of pressurized fluid. Fluid which leaks from the recesses in the surfaces 180 gathers in the internal space 183 of the shell 121. Instead of being assembled into groups of three, the deforming elements 127 can be gathered into groups of two or into groups of three or more. The hoses 182 connect the source 186 with the stubs 184 (only one shown) at the ends of the carrier 122. The manner in which the secondary deforming elements 128 can be assembled into groups of two, three or more and connected with the source 186 is or can be the same as descibed in connection with the deforming elements 127. The manner in which the fluid which gathers in the internal space 183 of the shell 122 is recirculated into the source 186 is not shown in FIG. 3. Reference may be had to commonly owned U.S. Pat. No. 4,757,583 to Pav et al.

A pump 185 is provided to convey the fluid from the source 186 which includes or constitutes a heater and is further connected with a control unit 164 as well as with an adjusting device 147 which selects the temperature of fluid flowing into the shell 122 via hoses 182. The device 147 further selects the pressure p of fluid which enters the recesses in the surfaces 180 and 181. Thus, the source 186 forms part of the means for adjusting the deforming elements 127, 128 to thereby determine the extent of deformation of selected portions of the shell 121 as well as of the means for heating the shell 121 to a predetermine temperature. The pressure and the temperature are selected by the control unit 164 in a manner as described above in connection with the control unit 64 of FIG. 2. The temperature of fluid in the source 186 can be constant if the adjusting device 147 is constructed and operates in a manner as disclosed in commonly owned U.S. Pat. No. 4,729,153 to Pav et al. The utilization of such adjusting device renders it possible to selectively heat different portions of the shell 121 to different temperatures. Those portion of the shell 121 which are adjacent discrete groups of three deforming elements 127 and 128 then constitute different temperature zones.

FIG. 3 further shows a presently preferred mode of employing a shell 121 whose end portions are movable radially relative to the respective end portions of the carrier 122 but the end portions of the shell can be fixed or located in selected positions. The illustrated bearing 130 for the right-hand end portion of the shell 121 of FIG. 3 is surrounded by the internal surface of the respective end portion of the shell 121 and, in turn, surrounds a ring 187 having two pistons 188, 189 which are disposed diametrically opposite each other and extend into the chambers 190, 191 of two cylinders 192, 193 forming integral parts of the carrier 122. The two motors including the pistons 188, 189 and the respective cylinders 192, 193 can receive pressurized hydraulic fluid from the source 186 via adjusting device 147 and valve means 194 which can be said to form part of the means for locating the ring 187, and hence the respective end portion of the shell 121, in a selected position relative to the carrier 121. Thus, if the valves 194 are closed, the hydraulic fluid which is entrapped in the cylinder chambers 190, 191 prevents the pistons 188, 189 from moving radially relative to the carrier 121. Moreover, the motor 189, 193 constitutes an additional primary deforming element, and the motor including the piston 188 and cylinder 192 constitutes an additional secondary deforming element for the right-hand end portion of the shell 121. When the valves 194 are open or at least partly open, the just described motors can be used as primary and secondary deforming elements. However, when the valves 194 are closed, the pistons 188, 189 and the corresponding cylinders 192, 193 act as a means for locating the right-hand end portion of the shell 121 in a selected position with reference to the corresponding end portion of the carrier 122. Reference may be had to commonly owned U.S. Pat. No. 4,848,119.

The adjusting device 147 can regulate the operation of the motors including the pistons 188, 189 and cylinders 192, 193 in such a way that the chamber 191 is free to discharge fluid while the chamber 190 receives pressurized fluid so that the motor 188, 192 performs the function of a secondary deforming element and enables the respective end portion of the shell 121 to assume a shape conforming to that of the adjacent portion of the topmost intermediate roll 106 before the shell 121 is caused to engage the roll 106.

Figure 4:
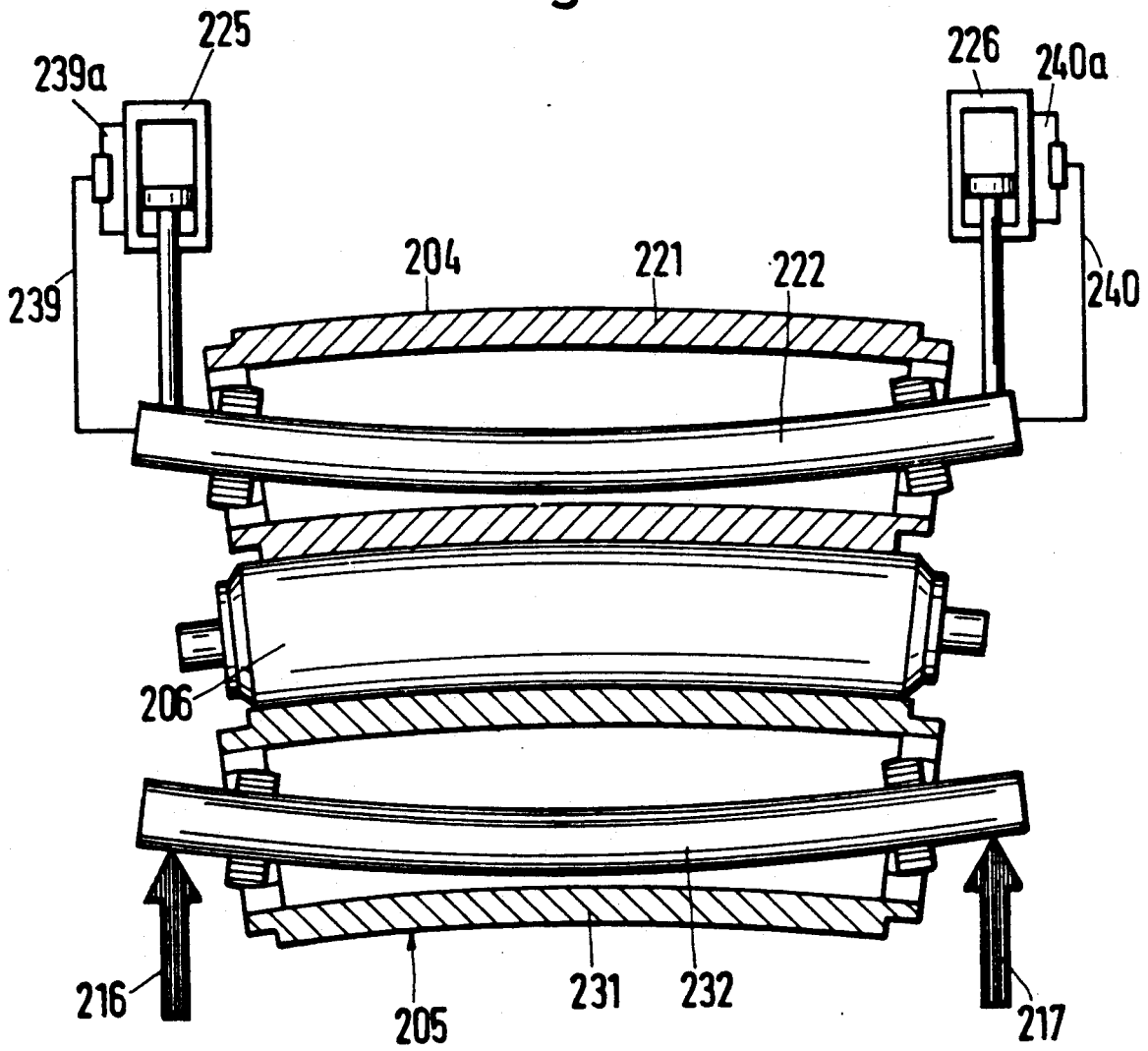
FIG. 4 is a fragmentary partly front elevational and partly longitudinal vertical sectional view of a fourth calender.

FIG. 4 shows a portion of a further calender. All such parts which are identical with those of the calender of FIG. 1 are denoted by similar reference characters plus 200. This calender comprises a bottom roll 205, a top roll 204 and a single intermediate roll 206. The adjustable deforming elements (not shown) in the shells 221 and 231 can be identical with the deforming elements 27, 28 and 35, 36 of FIG. 1. The end portions of the shell 221 are movable radially relative to the corresponding end portions of the carrier 222 but can be located or locked in selected radial positions in a manner as described in connection with FIG. 3. The shell 231 of the bottom roll 205 is or can be mounted on the carrier 232 in such a way that its end portions cannot move radially of the carrier. The mode of operation of this relatively simple calender is analogous to that of the calenders of FIGS. 1 and 2.

The improved calender can embody the features of many other conventional calenders without departing from the spirit of the invention. It has been found that the calender can be operated with particular advantage if it embodies at least some of the features which are described in the aforementioned commonly owned copending patent application and in the aforementioned commonly owned patents.

An important advantage of the improved method and calender is that deformation of the top roll 4, 104 or 204 prior to narrowing of the nip of the top roll with the adjacent intermediate roll ensures that the generatrix of the peripheral surface of the top roll in a plane including the uppermost nip, the axis of the top roll and the axis of the adjacent intermediate roll equals the generatrix of the peripheral surface of the topmost intermediate roll. Thus, no additional bending or other deformation of the top roll must take place during narrowing of the nip of such top roll with the adjacent roll. This renders it possible to greatly reduce or eliminate the load in the nip of the top roll with the adjacent roll and the useful life of the intermediate roll next to the top roll is prolonged considerably, especially if such intermediate roll has an elastically deformable outer layer. Moreover, a reduction of load in the nip of the top roll with the adjacent intermediate roll entails a reduction of load in each other nip of the calender. This ensures that the desired gloss, smoothness and/or other advantageous parameters of the treated material can be achieved without excessive condensation of such material. The novel method renders it possible to achieve heretofore unknown glazing effects by resorting to modern supercalenders.

Since the peripheral surface of the shell 21, 121 or 221 comes into linear contact with a web in the topmost nip across the full width of the web in immediate response to narrowing of the topmost nip, the distribution of stresses upon the web as well as upon the top roll and the adjacent intermediate roll is more uniform than in heretofore known calenders. This holds true irrespective of whether the topmost intermediate roll is a hard roll or is provided with an elastic outer layer. Absence of damage to the topmost intermediate roll reduces the likelihood of wrinkling and tearing of and/or other damage to the material during threading through the nip of the top roll with the adjacent intermediate roll.

The lower limit of nip load for any particular nip is determined by the weight of the roll or rolls above the respective nip plus the weight of parts which share the movements of such roll or rolls. If the nip load is to be increased, it is desirable to stress the top roll and/or the bottom roll only after the narrowing of the topmost nip is already completed. Therefore, such additional stressing of the top roll and/or bottom roll cannot adversely influence the aforedescribed desirable initial deformation of the shell of the top roll and/or bottom roll in order to ensure that the shape of each such shell will conform to that of the adjacent intermediate roll.

The aforedescribed stepwise deformation of the shell of the bottom roll during narrowing of successive nips (starting at the lowermost nip and proceeding toward the nip of the top roll with the adjacent intermediate roll) ensures that the nip load is uniform in each and every nip in spite of the fact that the bottom roll is called upon to bear the weight of one or more intermediate rolls and ultimately also the weight of the top roll. This procedure prevents the development of peak loads in the nips, even in the nip wherein the load is higher than in all other nips.

The aforediscussed feature of selecting the nip load in the nips of the top and bottom rolls with the adjacent intermediate rolls (when the calender comprises two or more intermediate rolls) in such a way that the load distribution is uniform in the nips nearest to the top and bottom rolls as well as in the adjacent nips (i.e., in the nips 50 and 56 shown in FIG. 2) ensures even more uniform stressing of the material which is caused to advance through the calender.

Any localized changes of nip load are carried out in such a way that additional forces are superimposed upon the previously selected forces. Such additional changes might become necessary when the monitored parameters of the material deviate from the desired parameters. This ensures that any deviations of the quality of treated material from optimum quality are eliminated practically immediately after detection.

Calculation of the necessary extent of deformation of the shell of the top roll and/or bottom roll in accordance with a predetermined algorithm can be carried out with a very high degree of accuracy. The same holds true for advance determination of the nip load. For example, and since all data pertaining to the intermediate roll(s) and to the bottom roll are known, the computer can readily calculate the desired shape of the shell of the top roll and/or the load in the nip of the top roll with the adjacent roll. As already mentioned above, the value of load in the nip of the top roll with the adjacent intermediate roll can be reduced to zero or to a very small value by compensating for the weight of the top roll. For example, the load in the nip of the top roll with the adjacent roll can be reduced to 2 N/mm, and such load can be uniform across the full length of the nip. This amounts to a reduction of nip load in the range of 20 to 45 N/mm which, in turn, enables the calender to achieve heretofore unknown technological effects.

Heating of the top roll to a predetermined temperature also produces new and heretofore unknown effects. For example, when the calender is used for satinizing or glazing of paper webs, the web to be treated normally enters the topmost nip and leaves the calender by passing through the lowermost nip. The relatively cold web is subjected to a thermal shock as a result of contact with the heated top roll which, in turn, results in pronounced plastification of the surface layers of the web. This means that a desired value of smoothness, gloss and/or other sought-after parameters can be achieved with lower nip loads or with moderate nip loads but a smaller number of nips. In either event, the heated top roll exerts a beneficial effect upon the specific volume of treated material. A reduction of the required number of nips contributes to compactness of the calender and reduces the maintenance cost, especially if the calender comprises one or more intermediate rolls with elastic outer layers because such rolls require an overhaul at regular intervals. Moreover, and if the top roll is heated in a calender with a large number of intermediate rolls, the gloss and smoothness of the treated material can be improved to a heretofore unattainable degree.

Heating of the top roll in addition to aforediscussed deformation of such top roll prior to narrowing of the topmost nip brings about a number of important advantages. Satinizing involves a plastoelastic treatment of a paper web in the nip. The work which is necessary to bring about the desired changes in form and characteristics of the web is accomplished in response to supplying of required mechanical and thermal energy. In order to achieve a uniform technological result, it is necessary to supply to each unit area of the paper web identical quantities of specific energy. The percentages of the two forms of energy exert a very pronounced influence upon the development of properties of the treated web. Thus, and since the novel method of operating the calender renders it possible to operate with low nip loads while heating the top roll to an elevated temperature, such treatment offers the possibility of achieving heretofore unknown satinizing effects without adversely affecting the specific volume of the web.

Additional desirable and advantageous effects can be achieved by properly heating the bottom roll and/or one or more intermediate rolls. For example, such additional heating can involve admission of controlled amounts of heat energy to the bottom roll and at least one intermediate roll. This renders it possible to reduce the nip load in the respective nips because a reduction of mechanical energy is compensated for by increased thermal energy. The optimum temperature of the top roll and, if necessary, one or more additional rolls can be calculated in accordance with a predetermined algorithm. The initial calculation can be based upon empirically obtained data and is modified as a result of monitoring of the web. The nip load and the temperature can be regulated in such a way that the energy which is applied as a result of nip load and the heat energy are related in a manner which is a function of the desired parameters of the treated material. This results in optimum treatment of the material. Thus, and if the calender is equipped with a moisturizing device, the initial moisture content of the web of paper which enters the nip of the top roll with the adjacent intermediate roll can be much higher than heretofore if the top roll is subjected to a controllable heating action. It has been found that a paper web which has a relatively high moisture content and is treated in a calender wherein the top roll is heated will exhibit superior properties even if the load in the nip of the top roll with the adjacent roll is very low. This is due to the fact that such treatment enhances the binding capacity of fibrous constituents of the paper web which, in turn, enhances the strength (such as breaking length and ultimate tensile strength) and printability (including smoothness and gloss) of treated material to an extent which cannot be achieved in accordance with heretofore known satinizing techniques without any heating of the top roll. Actual moisturizing can be preceded by a monitoring of the initial moisture content of the web in order to ascertain whether or not it is necessary to moisturize as well as to ascertain the necessary degree of moisturizing. As mentioned above, if the top roll is heated, the moisture content of a paper web which enters the nip of the top roll with the adjacent roll is preferably between 7 and 18 percent by weight, particularly between 9 and 18 percent and most preferably between 9 and 15 percent. The temperature of the top roll is preferably between 80° and 160° C., most preferably between 100° and 140° C. This results in a highly satisfactory combination of thermomechanical treatment of a web having a relatively high moisture content in order to enhance the combining capacity of fibrous constituents of the paper web.

The feature which is shown in FIG. 3, namely that the motors 188, 192 and 189, 193 constitute two additional deforming elements at each end of the shell 121, renders it possible to greatly enhance the bending moments upon the shell and to ensure that the shell can assume certain shapes which cannot be achieved in heretofore known rolls with deformable shells. The feature that the cylinders 192, 193 constitute integral parts of the carrier 122 contributes to simplicity and lower cost of the top roll.

The feature that the end portions of the shell 121 shown in FIG. 3 can be located in preselected positions by closing the valves 194 also contributes to versatility of the improved top roll. Thus, it is possible to select predetermined reference points for the end portions of the shell 121 preparatory to admission of pressurized fluid into selected primary and/or secondary deforming elements 127, 128 in order to ensure that the shape of the shell 121 will match the shape of the adjacent intermediate roll 106. This renders it possible, in many instances, to admit pressurized fluid only to selected secondary deforming elements 128 in order to ensure that the shape of the deformed shell 121 will adequately conform to that of the roll 106.

The motors 188, 192 and 189, 193 exhibit the additional advantage that, when they act as a means for locating the end portions of the shell 121 relative to the adjacent portions of the carrier 122, and the carrier is suspended on two motors (25, 26) which are operable (by 39*a*, 40*a*) to ensure a highly accurate selection of the level of the carrier 122, the calender embodying the structure of FIG. 3 is indeed capable of reducing the load in the nip of the rolls 104, 106 to zero or close to zero because the carrier 122 bears the weight of the shell 121 when the valves 194 are closed and, therefore, the shell must share all upward and downward movements of the carrier.

Controlled heating of the top roll is desirable and advantageous for the aforediscussed reasons, i.e., that it is possible to raise the initial moisture content of a web of paper which is to be satinized during travel through the nips of rolls in the calender and that the treatment cannot adversely affect the specific volume of the paper web. Moreover, the web can be subjected to extensive treatment during travel through the topmost nip even if the pressure in such nip is relatively low or close to zero. Still further, controlled heating of the top roll renders it possible to eliminate streaks of moisture from the running web.

The feature that the medium which heats the top roll can be used for adjustment of deforming elements in a calender roll is disclosed in commonly owned U.S. Pat. No. 4,757,584 to Pav et al. However, this patent does not disclose the advantages of heating the top roll in a calender for the purpose of avoiding adverse effects upon the specific volume of a web which undergoes a satinizing treatment.

The computer of the control unit which is used in the improved calender can carry out the necessary calculations on the basis of data pertaining to the calender as well as on the basis of empirically obtained data. In addition, and as described in connection with FIG. 2, the computer can receive information from devices which monitor the running web as well as from sensors which monitor the temperature of some or all of the rolls. This enables the computer to transmit necessary information to the regulator which, in turn, carries out all necessary adjustments of form, pressure and/or temperature by ensuring optimum supplying of mechanical and thermal energy for selected nips or all nips of the rolls.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. A method of operating a calender, particularly a supercalender, wherein a bottom roll and a deformable top roll flank and respectively define first and second nips of variable width with at least one intermediate roll having a predetermined shape adjacent the nip or nips and a material to be calendered is threaded through the nips, comprising the steps of deforming the top roll so that its shape conforms to that of the at least one intermediate roll adjacent the second nip; reducing the width of one of the first and second nips; and reducing the width of the other of the first and second nips.

2. The method of claim 1, wherein said deforming step precedes the step of reducing the width of the second nip and the step of reducing the width of the first nip precedes the step of reducing the width of the second nip.

3. The method of claim 2, further comprising the step of applying a load to at least one of the bottom and top rolls in a direction to urge the at least one of the top and bottom rolls toward the at least one intermediate roll upon completion of the width reducing steps.

4. The method of claim 3, wherein said load applying step includes applying to the at least one of the top and bottom rolls a force other than gravity.

5. The method of claim 3, wherein said load applying step includes establishing uniform load distribution in that nip which is adjacent the nip of the at least one of the bottom and top rolls with the at least one intermediate roll.

6. The method of claim 5, further comprising the steps of monitoring at least one parameter of calendered material, comparing the monitored parameter with a reference value, and applying to at least one of the bottom and top rolls at least one additional load when the monitored parameter deviates from the reference value so as to eliminate or reduce the deviation.

7. The method of claim 2 of operating a calender wherein the bottom roll is deformable, further comprising the step of deforming the bottom roll not later than during reduction of the width of the first nip so as to establish uniform load distribution in the first nip.

8. The method of claim 7, wherein said step of deforming the bottom roll includes accounting for the influence of the weight of at least one intermediate roll upon the bottom roll on the load distribution in the first nip.

9. The method of claim 7, wherein said step of deforming the bottom roll includes establishing uniform load distribution in the first nip and in the nip which is adjacent the first nip.

10. The method of claim 7, further comprising the steps of monitoring at least one parameter of calendered material, comparing the monitored parameter with a reference value, and applying to at least one of the top and bottom rolls at least one additional load when the monitored parameter deviates from the reference value so as to eliminate or reduce the deviation.

11. The method of claim 2, further comprising the step of calculating the desired configuration of the top roll in accordance with a predetermined algorithm, said deforming step including deforming the top roll in accordance with the results of the calculating step.

12. The method of claim 2, further comprising the step of calculating the desired load distribution in the second nip in accordance with a predetermined algorithm, said deforming step including deforming the top roll in accordance with the results of said calculating step.

13. The method of claim 2, further comprising the step of compensating, at least in part, for the effect of the weight of the top roll upon the width of the nips.

14. A method of operating a calender, particularly a supercalender, wherein a bottom roll and a deformable top roll flank and respectively define first and second nips of variable width with at least one intermediate roll which has a predetermined shape adjacent the second nip and a material to be calendered is threaded through the nips, comprising the steps of heating at least a portion of the top roll to be a predetermined temperature; deforming the top roll so that its shape conforms to that of the at least one intermediate roll; thereupon reducing the width of the first nip; and thereupon reducing the width of the second nip.

15. The method of claim 14, further comprising the step of heating the bottom roll to be a predetermined temperature.

16. The method of claim 14, further comprising the step of heating the at least one intermediate roll to a predetermined temperature.

17. The method of claim 14 of calendering webs of paper, further comprising the step of moisturizing the webs prior to threading through the nips.

18. The method of claim 17, wherein said moisturizing step includes raising the moisture content of paper to between 7 and 18 percent by weight.

19. The method of claim 17, wherein said moisturizing step includes raising the moisture content of paper to between 9 and 18 percent.

20. The method of claim 19, wherein said moisturizing step includes raising the moisture content of paper to between 9 and 15 percent.

21. The method of claim 14, wherein said heating step includes raising the temperature of said portion of the top roll to between 80° and 160° C.

22. The method of claim 21, wherein said heating step includes raising the temperature of said portion of the top roll to between 100° and 140° C.

23. A calender, particularly a supercalender, comprising a deformable top roll including a carrier and an elongated deformable cylindrical shell spacedly surrounding said carrier; a bottom roll; at least one intermediate roll defining with said bottom and top rolls first and second nips of variable width and having a predetermined shape adjacent said second nip; means for moving said top roll relative to said bottom roll to thereby vary the width of at least one of said nips; and means for deforming said top roll relative to and independently of said at least one intermediate roll, including means for imparting to the top roll a shape conforming to that of said at least one intermediate roll and said imparting means including a plurality of adjustable deforming elements disposed between said carrier and said shell and forming at least one row of primary deforming elements nearer to and at least one row of secondary deforming elements remote from said second nip, said rows extending longitudinally of said shell and said imparting means further comprising means for adjusting said deforming elements.

24. The calender of claim 23, wherein said shell includes first and second end portions and said top roll further comprises first and second rings spacedly surrounding said carrier and rotatably journalled in the respective end portion of said shell, and further comprising means for moving said rings relative to said carrier substantially radially of said shell.

25. The calender of claim 24, wherein the moving means for each of said rings includes a first fluid-operated motor adjacent and a second fluid-operated motor remote from said second nip.

26. The calender of claim 25, wherein each of said motors includes a piston on the respective ring and a cylinder for the piston on said carrier.

27. The calender of claim 26, wherein said cylinders are integral with said carrier and have cylinder chambers for the respective pistons.

28. The calender of claim 23, wherein said shell has first and second end portions and further comprising means for locating said end portions in predetermined positions relative to said carrier.

29. The calender of claim 28, wherein said locating means includes at least one fluid-operated motor for each end portion of said shell, each of said motors including a cylinder on one of the parts including said carrier and the respective end portion of said shell and a piston provided on the other of said parts and extending into said cylinder, and valve means operable to confine a supply of fluid in the cylinder.

30. The calender of claim 23, further comprising a frame for said carrier, said carrier having first and second end portions and said moving means comprising motors provided on said frame and operable to move the end portions of said carrier relative to said intermediate roll, and means for operating said motors.

31. The calender of claim 23, further comprising adjustable heating means for said top roll and means for adjusting said heating means so as to maintain the temperature of a portion at least of said top roll within a predetermined range.

32. The calender of claim 31, wherein said heating means includes a source of heating fluid and means for connecting said source with the interior of said shell, said adjusting means including means for regulating the flow of heating fluid between said source and said shell.

33. The calender of claim 32, wherein said deforming elements include hydrostatic bearing elements and said connecting means includes means for connecting said bearing elements with said source, and further comprising means for regulating the flow of fluid between said source and said bearing elements.

34. The calender of claim 23, further comprising adjustable heating means for said at least one intermediate roll.

35. The calender of claim 23 for the treatment of paper webs which are threaded through said nips, further comprising means for moisturizing the webs prior to treatment of such webs in said nips.

36. The calender of claim 23 for treatment of webs which advance through said nips, further comprising means for monitoring at least one parameter of treated webs, said adjusting means being operative to adjust said deforming elements when the monitored parameter deviates from a desired parameter.

37. The calender of claim 36, further comprising adjustable means for heating at least one of said rolls, said adjusting means including means for adjusting said heating means as a function of deviation of monitored parameter from a predetermined parameter.

38. The calender of claim 23 for the treatment of material which advances through said nips, wherein said adjusting means comprises means for adjusting said deforming elements in accordance with a predetermined algorithm.

39. The calender of claim 38, further comprising adjustable means for heating at least one of said rolls, said adjusting means including means for adjusting said heating means in accordance with said predetermined algorithm.

40. The calender of claim 23, further comprising adjustable heating means for said bottom roll, said intermediate roll having a predetermined shape adjacent said second nip.

41. A method of operating a calender, particularly a supercalender, wherein a bottom roll and a deformable top roll flank and respectively define first and second nips of variable width with at least one intermediate roll and a material to be calendered is threaded through the nips, comprising the steps of calculating the desired temperature of at least a portion of the top roll in accordance with a predetermined algorithm; heating said portion of the top roll to a predetermined temperature including selecting the temperature of said portion of the top roll in accordance with the results of said calculating step; reducing the width of one of the first and second nips; and reducing the width of the other of the first and second nips.

42. A method of operating a calender, particularly a super calender, wherein a bottom roll and a deformable top roll flank and respectively define first and second nips of variable width with at least one intermediate roll and a material to be calendered in threaded through the nips, comprising the steps of heating at least a portion of the top roll to a predetermined temperature; reducing the width of one of the first and second nips; reducing the width of the other of the first and second nips; and regulating the ratio of load distribution upon the material in the second nip to the influence of heat energy upon the material in the second nip as a function of desired parameters of calendered material.

* * * * *